United States Patent [19]

Fromson et al.

[11] Patent Number: 4,640,169

[45] Date of Patent: Feb. 3, 1987

[54] CEMENTED CARBIDE CUTTING TOOLS AND PROCESSES FOR MAKING AND USING

[75] Inventors: Robert E. Fromson, Wilkins Township, Allegheny County; Ram Kossowsky, Pittsburgh, both of Pa.; Charles S. Nunamaker, Amherst, N.Y.

[73] Assignee: Westinghouse Electric Corp., Pittsburgh, Pa.

[21] Appl. No.: 717,480

[22] Filed: Mar. 28, 1985

Related U.S. Application Data

[63] Continuation of Ser. No. 342,525, Jan. 25, 1982, abandoned.

[51] Int. Cl.[4] ..... B26F 1/14; B21D 28/34

[52] U.S. Cl. ..... 83/685; 76/107 R; 76/DIG. 11; 148/4; 148/39; 204/192.31; 83/651; 83/701; 30/350

[58] Field of Search ..... 83/701, 651, 915.5, 83/685; 76/107 R, DIG. 11; 148/4, 39; 204/192 N; 30/350

[56] References Cited

U.S. PATENT DOCUMENTS 3,832,219 8/1974 Nelson ..... 117/93.3
3,900,636 8/1975 Curry et al. ..... 30/346
4,105,443 8/1978 Dearnaley et al. ..... 75/238

FOREIGN PATENT DOCUMENTS 1598814 9/1981 United Kingdom .

OTHER PUBLICATIONS

G. Dearnaley, "The Ion Implantation of Metals and Engineering Materials", Transactions of the Institute of Metal Finishing, 1978, vol. 56, pp. 25–31.

N. E. W. Hartley, "Ion Implantation Case Studies", Surface Treatments for Protection, University College, Cardiff, Apr. 7–10, 1978.

G. Dearnaley, "Practical Applications of Ion Implantation", Ion Implantation Metallurgy Proceedings, Materials Research Society, Nov. 1979.

"Ion Implantation Improves Wear Resistance of Hard Metals", Metal Powder Report, vol. 35, No. 2, Feb. 1980, pp. 64–66.

*Primary Examiner*—Donald R. Schran
*Attorney, Agent, or Firm*—D. M. Satina

[57] ABSTRACT

Resharpenable cemented carbide cutting tools which have been treated by ion implantation, as well as a method of making and using these tools, are described. Applicants have found that the benefits of the initial ion implantation on cemented carbide tool life will remain after sharpening of the tool.

10 Claims, 5 Drawing Figures

CEMENTED CARBIDE CUTTING TOOLS AND PROCESSES FOR MAKING AND USING

This application is a continuation of application Ser. No. 342,525, filed Jan. 25, 1982, now abandoned.

The present invention relates to the field of cemented carbide cutting tools having a wear resistant layer beneath their surface. This invention is particularly pertinent to those cemented carbide cutting tools which are typically sharpened and reused at least once after the initial dulling of the cutting edge or are used to cut material, especially metallic material, by a shearing mode.

It has recently been found that high energy ion implantation can be a useful technique for improving the production lifetime of cemented carbide metal forming tooling. For example, Dearnaley et al. U.S. Pat. No. 4,105,443 indicates that the production lifetime of cemented carbide wire drawing dies can be significantly improved by carbon ion implantation.

It has also been reported that the lifetime of cemented carbide slitter blades cutting synthetic rubber can be significantly improved by nitrogen ion implantation. However, in this later application it is generally believed necessary to ion implant both adjoining faces forming the cutting edge of the slitter blade. One of the problems this causes is that even though the rate of wear of the cutting edge has been reduced, during the blade's lifetime it will still have to be resharpened in order to get full use out of the blades. It has been generally believed that the ground blade surface (the circumferential surface) would then have to be reimplanted to retain improved wear resistance. This is both inconvenient and costly to the tool user.

In accordance with the present invention, a cemented carbide cutting tool, having a first surface joined to a second surface at a cutting edge, is provided with a wear-resistant layer located near the cutting edge and beneath and parallel to one of said first and second surfaces, while only intersecting the other surface. Also in accordance with this invention, applicants have found that the wear-resistant layer should be made by the process of implantation of high energy ion species. Ion implantation forms wear-resistant layers comprising irradiation defects and microstructural modifications and a high concentration of the implanted species which may extend inwardly as far as 1000 angstroms, and more typically below 400 angstroms.

Preferably the cutting tools formed in accordance with the method of the present invention are cemented carbide punches and dies for use in perforating material. In these embodiments of the present invention, preferably only the peripheral faces of the punch adjacent to the cutting edge and the wall faces of the die adjacent to the cutting edge are ion implanted.

Also in accordance with the present invention applicants have found an improved process for using ion implanted cemented carbide cutting tools. The dulled ion-implanted tool is resharpened and then used again without reimplantation of the ground surfaces. This process of use and resharpening may be repeated many times while still retaining a significant improvement in tool life without subsequent reimplantation.

These and other aspects of the present invention will become more apparent upon review of the drawings in conjunction with the following detailed description of the invention.

DETAILED DESCRIPTION OF THE INVENTION

Figure 1:
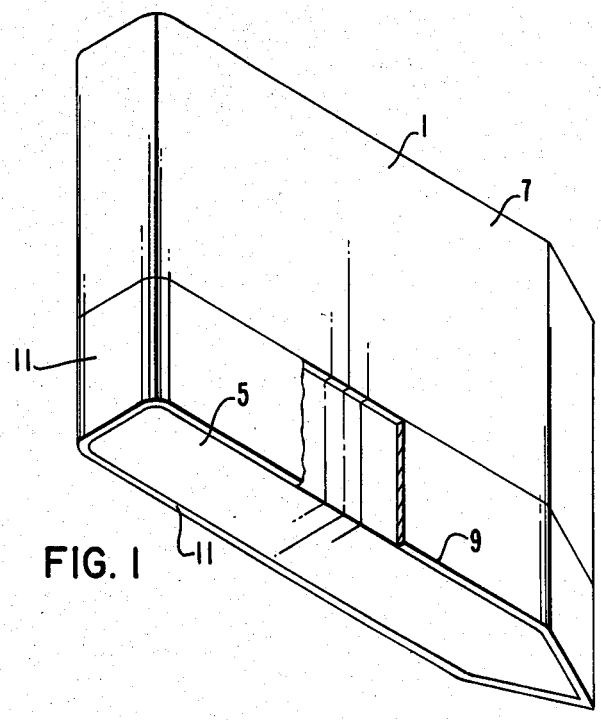
FIG. 1 shows a not to scale embodiment of a cemented carbide punch according to the present invention.
Figure 2:
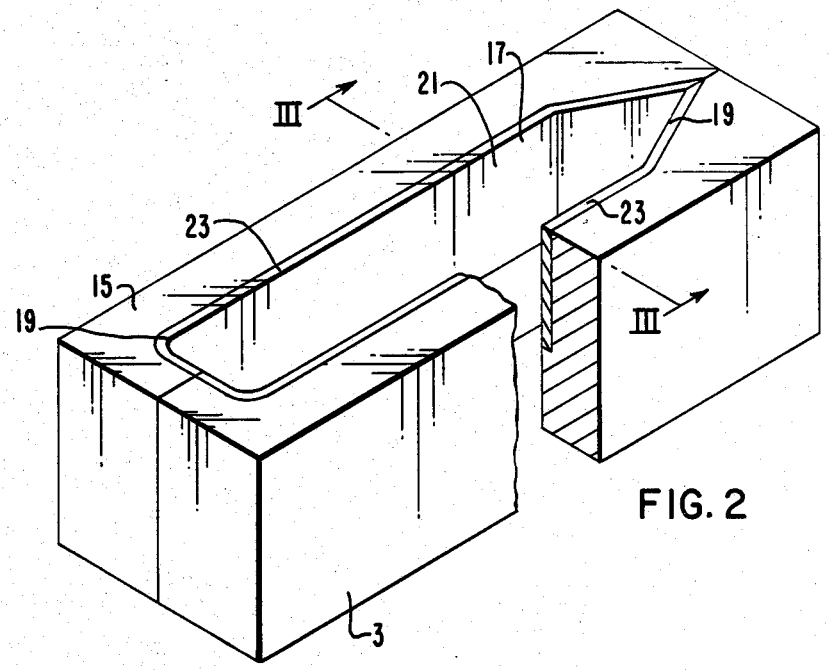
FIG. 2 shows a not to scale embodiment of a cemented carbide die according to the present invention.

In accordance with the present invention FIGS. 1 and 2 illustrate cutting tools which have been ion implanted. In FIG. 1 a punch 1 having a first or leading face 5 and a second, flank, peripheral surface or side wall 7 joined to it at a cutting edge 9 is illustrated. The side wall 7 has been ion implanted in the region 11. Ion implantation produces a wear-resistant layer beneath the surface that has been ion implanted. In cemented carbides this layer may extend inwardly from the surface as deep as 1000 angstroms in depth, but is typically below 400 angstroms in depth. The concentration of the species of ion which has been implanted is typically in a gaussian like distribution beneath the implanted surface, however, extending from the implanted surface down to the deepest penetration of the ions are radiation-produced defects and modifications in the microstructure which have been caused by the high energy ions passing through the material. As can be seen in this Figure, only the peripheral face 7 of the tool has been ion implanted such that a wear-resistant layer 11 is produced beneath and parallel to the flank surface 7 while intersecting the leading face 5 of the punch 1 near the cutting edge 9.

FIG. 2 shows a segmented die 3 which has been implanted along its side walls 17 or peripheral surface much in the same manner as the aforementioned punch 1. The segmented die has a leading face 15 which is joined to the peripheral surface 17 at a cutting edge 19. The wear-resistant layer 23 lies beneath and parallel to the peripheral surface 17 at 21 and intersects the leading face 15 near the cutting edge 19. A segmented die is preferred over a single piece die to facilitate ion implantation of the internal side walls 17 of the die since ion implantation is a line-of-sight process and is most efficiently done when the beam is substantially perpendicular to the surface being implanted.

Figure 3:
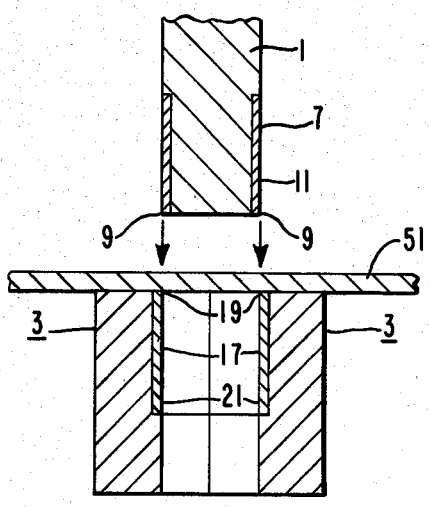
FIG. 3 shows a cross section through the punch and die according to the present invention just prior to perforating a workpiece.

FIG. 3 is a cross section through the punch 1 and die 3 of FIGS. 1 and 2 which are shown here aligned with a sheetlike material 51 between them which is to be perforated. In a perforation operation such as that shown here, the punch 1 interacts with the die walls 17 and cutting edge 19 of the punch 3 to punch out a perforation having a shape substantially in accordance with the shape of the leading face of the punch and the cavity in the die 3. The ion-implanted layer 11 in the side wall 7 of the punch and the ion-implanted layer 21 in the side wall of the die 3 while greatly extending the number of perforations that can be made with this tool will not cause the cutting edges 9 or 19 to last forever and at some point these cutting edges will have to be resharpened. Applicants have found that when this occurs the leading faces of the punch 1 and die 3 may be ground back to produce a sharpened edge without additional implantation of the leading faces 5 and 15. The following example illustrates the method and cutting tools according to the present invention.

EXAMPLE

A cemented carbide punch and a cemented carbide segmented die were ion implanted to produce a wear-resistant layer beneath and parallel to the implanted surfaces and estimated to extend inwardly from these surfaces approximately less than 1000 angstroms. The punch and die having a shape substantially as shown in FIGS. 1 and 2 were composed of approximately 0.8 to 1.0 micron size tungsten carbide particles bonded together by approximately 14 weight percent cobalt. Both the leading faces and the peripheral faces of the punch and die segments were implanted with nitrogen ions having an energy of 90 KeV until a dose of approximately $2\times10^{+17}$ ions/cm$^2$ was achieved in the treated surface areas. The punch and die were then mounted as a set in an index press operating at 900 strokes per minute. Perforations were made in 0.022 inch nominal thickness, low carbon steel sheet and also in 0.018 inch nominal thickness, silicon steel sheet in a single stroke, without lubrication, in which the punch traveled through the full thickness of the material. The runs on silicon and carbon steel sheet were intermixed with each other. In this manner a total of 2,100,000 and 1,830,000 perforations in low carbon and silicon steel, respectively, were made before the punch and die required resharpening. A diamond wheel was used to dry-surface grind the lead surfaces of the punch and die until sharp cutting edges were produced. This grinding step required removal of material to a depth greatly in excess of the original implanted wear-resistant layer. The punch and die were then used without honing of the cutting edges or additional ion implantation to the ground faces. An additional 3,000,000 perforations were then made in carbon steel sheet before a press malfunction aborted the study. Visual examination of the punch and die at this time revealed that the cutting edges were still in an acceptable condition.

The 3,000,000 perforations, however, do represent a significant improvement over the life of unimplanted cemented tungsten carbide punches and dies, which typically produce 1,000,000 perforations in low carbon steel or approximately 500,000 perforations in silicon steel per sharpening.

It can, therefore, clearly be seen that a significant improvement in punch and die life can be obtained due to ion implantation even after the wear-resistant layer in one of the faces adjoining the cutting edge of the tool has been removed. Therefore, it is also believed that significant improvements in punch and die life can be obtained where, during the original implantation step, only the peripheral surfaces or side walls of the tools are implanted such that the wear-resistant layer produced intersects the lead face of the tool as shown in the Figures.

Figure 4:
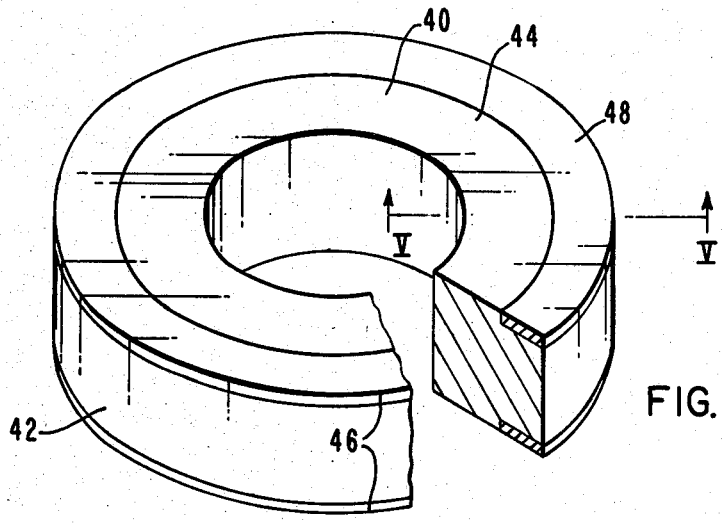
FIG. 4 shows another not to scale embodiment of a cemented carbide cutting tool according to the present invention.
Figure 5:
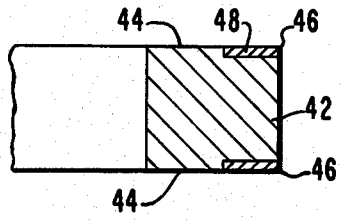
FIG. 5 shows a cross section of the FIG. 4 embodiment taken along arrows IV—IV.

While the present invention has been illustrated by its application to cemented carbide punch and dies, it is not limited to that embodiment. For example, as shown in FIGS. 4 and 5, it is also believed that cemented carbide slitter blades 40 which have an ion-implanted wear-resistant layer only in their side walls 44 can achieve significant increased lifetime over unimplanted blades. This means that the originally implanted blade 40, whether it was implanted solely on its side walls 44 or on its side walls 44 and circumferential surface 42 can be resharpened by grinding of the circumferential surface 42 leaving only the thin wear-resistant layer 48 beneath and parallel to the side walls 44 and intersecting the circumferential wall 42 near the cutting edge 46. In this manner the benefits of ion implantation can be extended throughout the lifetime of the blade without reimplantation of ground surfaces after each sharpening.

The above embodiments of this invention are illustrative and do not limit the scope of invention, which is covered by the following claims.

We claim:

1. A resharpenable cemented carbide cutting tool, said cutting tool having a cemented carbide cutting edge hardened by ion implantation and being resharpenable for reuse without further ion implantation, said cutting tool comprising:

a first surface;

a second surface joining said first surface;

a cemented carbide cutting edge formed at the junction of said first and said second surfaces;

a wear-resistant layer located along said first surface and extending away from said cutting edge and said second surface beneath and parallel to said first surface to a depth of up to approximately 1000 angstroms, and intersects said second surface in a zone up to approximately 1000 angstroms wide; the hardening of the cutting edge by ion implantation along only said first surface and not along said second surface enabling resharpening of the cutting tool by removing material from said second surface, said second surface being hardened only in a zone up to approximately 1000 angstroms wide at the intersection of said first surface and said second surface.

2. The cemented carbide cutting tool according to claim 1 wherein said wear-resistant layer includes irradiation-damaged metal carbide particles and irradiation-damaged modified metallic binder.

3. The cemented carbide cutting tool according to claim 2 wherein said wear-resistant layer includes a foreign species implanted by ion implantation.

4. The cemented carbide cutting tool according to claim 1 wherein said wear-resistant layers extends inwardly up to 400 angstroms maximum.

5. The cemented carbide cutting tool according to claim 3 wherein said foreign species is nitrogen.

6. A resharpenable punch having a hardened cutting edge for use in perforating sheetlike material, wherein said punch comprises:

a cemented carbide body having;

a leading face having a shape when viewed in plan similar to the shape of the perforation to be stamped, a peripheral surface joined to said leading face, a cutting edge formed at the junction of said peripheral surface and said leading face, a layer of wear-resistant material substantially parallel to and extending inwardly away from only said peripheral surface up to approximately 1000 angstroms in depth, said layer of wear-resistant material being formed by implantation of ions, and said layer of wear-resistant material intersecting said leading face only in a zone up to approximately 1000 angstroms wide, the punch being resharpenable by removing material from said leading face, the removal of material from said leading face being enabled by the relatively narrow zone of ion implanted material on said leading face at the intersection of said leading face and said peripheral surface.

7. The punch according to claim 6 wherein said layers of wear-resistant material includes irradiation-damaged cemented carbide.

8. The punch according to claim 7 wherein said layer of wear-resistant material further includes an implanted species.

9. The punch according to claim 8 wherein nitrogen comprises said implanted species.

10. A resharpenable die comprising a cemented carbide body, said die being hardened by ion implantation and being resharpenable for reuse without further ion implantation, said die having;

a top face, a bottom face, a die cavity wall communicating between said top face and said bottom face, a cutting edge formed at the junction of said die cavity wall and said top face, a layer of wear-resistant material substantially parallel to and extending inwardly up to approximately 1000 angstroms away from said die cavity wall, said layer of wear-resistant material resulting from ion implantation, and said layer of wear-resistant material intersecting said top face only in a zone up to approximately 1000 angstroms wide, said die being resharpenable and reusable without further ion implantation by removal of material from said top face, removal of material from said top face being enabled by ion implantation along only said die cavity wall, resulting in a zone of ion implantation of approximately only 1000 angstroms wide about the intersection of said top face with said die cavity wall.

* * * * *